US012503813B2

(12) United States Patent
Forgacs

(10) Patent No.: US 12,503,813 B2
(45) Date of Patent: Dec. 23, 2025

(54) S-SHAPED FLANGES THAT RETAIN A LAUNDRY BAG OPEN IN A DRAWER

(71) Applicant: Joshua Forgacs, Newport, RI (US)

(72) Inventor: Joshua Forgacs, Newport, RI (US)

(73) Assignee: Sortana LLC, Newport, RI (US)

( * ) Notice: Subject to any disclaimer, the term of this patent is extended or adjusted under 35 U.S.C. 154(b) by 0 days.

(21) Appl. No.: 18/731,244

(22) Filed: Jun. 1, 2024

(65) Prior Publication Data

US 2024/0318378 A1 Sep. 26, 2024

Related U.S. Application Data

(63) Continuation-in-part of application No. 17/990,199, filed on Nov. 18, 2022.

(60) Provisional application No. 63/281,124, filed on Nov. 19, 2021.

(51) Int. Cl.
*D06F 95/00* (2006.01)

(52) U.S. Cl.
CPC ..... *D06F 95/004* (2013.01)

(58) Field of Classification Search
CPC ..... D06F 95/004
USPC ..... 248/95
See application file for complete search history.

(56) References Cited

U.S. PATENT DOCUMENTS 2,137,652 A * 11/1938 Lundberg ..... B60R 13/0206 24/458
3,729,159 A * 4/1973 Foster ..... E04G 17/02 249/219.2
5,294,194 A * 3/1994 Lombardo ..... A47L 13/52 312/308
6,079,679 A * 6/2000 Mitchell ..... B60R 11/00 248/301
6,168,125 B1 * 1/2001 Winger ..... A47H 1/144 248/48.1
2012/0189230 A1 * 7/2012 King ..... F16B 2/245 383/33
2023/0160137 A1 * 5/2023 Forgacs ..... D06F 95/004 232/1 B

* cited by examiner

*Primary Examiner* — Anita M King
(74) *Attorney, Agent, or Firm* — Robert Joseph Hess; Hess Patent Law Firm

(57) ABSTRACT

A laundry sorting and processing system that keeps a laundry bag open in a furniture drawer as a portion of the bag is stretched around flanges that are in recesses of sidewalls of the drawer. Each flange has a central segment and two end segments that extend outward from the central segment. The central segment includes at least two parallel surfaces and two curved arc portions between the two parallel surfaces that form two bends, A middle parallel surface may be contiguous with each of the two curved arc portions, which separate the middle parallel surface from the two parallel surfaces. One of the end segments extends from one the parallel surfaces outward at a straight angle. Another of the end segments extends outward from the other parallel surface at an acute angle. The two end segments have a formation that facilitates securement of the flange in the recesses.

18 Claims, 4 Drawing Sheets

S-SHAPED FLANGES THAT RETAIN A LAUNDRY BAG OPEN IN A DRAWER

CROSS-REFERENCE TO RELATED APPLICATIONS

This application claims priority to and the benefit of U.S. Provisional Patent Application No. 63/281,124 titled "LAUNDRY SORTING AND PROCESSING SYSTEM AND METHOD" and filed Nov. 19, 2021, which is incorporated herein by reference in its entirety, and is a continuation-in-part of U.S. Utility patent application Ser. No. 17/990,199 filed Nov. 18, 2022, whose contents are incorporated herein by reference in its entirety.

STATEMENT REGARDING FEDERALLY SPONSORED RESEARCH OR DEVELOPMENT

Not applicable.

THE NAMES OF THE PARTIES TO A JOINT RESEARCH AGREEMENT Not applicable

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE

Not applicable.

BACKGROUND OF THE INVENTION

1. Field of the Invention

The present disclosure relates generally to laundry accessories, and more particularly, to a laundry sorting and processing system and method.

2. Description of Information Known to the Inventor, Including References to Specific Documents Related to the Invention, and Specific Problems Involved in the State of Technology that the Invention is Drawn Toward The parent patent application noted a need for a laundry sorting and processing system which is simple in design, easy to assemble, and enables a user to sort, process, and organize laundry.

SUMMARY OF THE INVENTION

The present disclosure is directed to a laundry sorting and processing system that keeps a laundry bag remains open in a furniture drawer by stretching a portion of the bag around flanges that are in recesses of sidewalls of the drawer. Each flange has a central segment and two end segments that extend outward from the central segment. The central segment includes at least two parallel surfaces and two curved arc portions between the two parallel surfaces that form two bends, A middle parallel surface may be contiguous with each of the two curved arc portions, which separate the middle parallel surface from the two parallel surfaces. One of the end segments extends from one the parallel surfaces outward at a straight angle. Another of the end segments extends outward from the other parallel surface at an acute angle. The two end segments have a formation that facilitates securement of the flange in recesses in sidewalls of the drawer.

The laundry sorting and processing system that allows users to separate soiled and clean laundry according to one or more categories such as, but not limited to, the owner of the laundry, the type of laundry item, etc. The laundry sorting and processing system may include soiled laundry and clean laundry containers and a plurality of preferably washable, laundry bags which may be removably placed inside the soiled laundry containers to receive soiled laundry, and thereafter be washed jointly with or separately from the soiled laundry. The laundry bags, the soiled laundry containers and/or the clean laundry containers may include an indicator used to distinguish the owner or user of the containers, the type of laundry items, etc. For example, the indicator may be a color of the laundry bags, the soiled laundry containers and/or the clean laundry containers that can be used to distinguish the owner or user of the containers, the type of laundry items, etc. The indicator could be a unique pattern that distinguish the owner or user of laundry placed in the laundry bags within the containers from patterns associated with others.

While the laundry sorting and processing system could also be used in a laundry closet, laundry room, and/or utility space, this laundry sorting and processing system may be preferably targeted for use at a site of a user getting dressed. The site of a user getting dressed may most commonly be a bedroom or a closet attached to a bedroom. Further, based on many homes, apartments, and living spaces lacking the space or resources required for a dedicated laundry room, it is useful to incorporate the functions of such a dedicated space into existing furniture and existing spaces (such as closets) using the laundry sorting and processing system described herein.

In an illustrative implementation of the embodiments described herein, a laundry sorting and processing system which is simple in design and easy to assemble and enables a user to sort, process and organize laundry may include a main frame. A plurality of soiled laundry containers may be supported by the main frame. A plurality of clean laundry containers may be supported by the main frame beneath the respective soiled laundry containers. A plurality of laundry bags may be nestable in the respective soiled laundry containers. Each laundry bag may be sized and configured to receive a load of soiled laundry.

The soiled laundry may be placed in the laundry bags nested in the respective soiled laundry containers, which may separate the laundry according to categories such as the owner of the laundry, for example. The laundry bags which contain the soiled laundry may be removed from the respective soiled laundry containers, closed and placed in a laundry washer/dryer to wash and dry the laundry. The laundry bag may be removed from the laundry washer/dryer, after which the cleaned and dried laundry may be removed from the laundry bag and placed in a corresponding one of the clean laundry containers for subsequent retrieval by the owner of the laundry. The laundry bags may be meshed.

The main frame of the laundry sorting and processing system may be configured as a piece of furniture, and the plurality of soiled laundry containers and the plurality of clean laundry containers may be carried by the piece of furniture.

In another aspect, wherein each soiled laundry container of the plurality of soiled laundry containers may include a container bottom, a plurality of container sidewalls, wherein at least one of the plurality of container sidewalls comprises an air vent, a container interior formed by the container bottom and the container sidewalls, and a pair of container flanges included in at least an opposite pair of container sidewalls of the plurality of container sidewalls. Each container flange of the pair of container flanges may extend along an opposite longitudinal direction of a respective container sidewall of the opposite pair of container sidewalls. Each container flange of the pair of container flanges may be configured to receive at least part (e.g., a sidewall) of one of the plurality of laundry bags.

The soiled laundry containers and clean laundry containers may be removable from the piece of furniture.

The piece of furniture may include a pair of spaced-apart sidewalls and a bottom wall and a top wall extending between the sidewalls, and the soiled laundry containers and the clean laundry containers may be insertable between the sidewalls and between the bottom wall and the top wall.

Handle slots may extend through the respective sidewalls of the piece of furniture for carrying purposes. Any and/or all of the sidewalls may include one or more air vents.

The above and other preferred features, including various novel details of implementation and combination of events, will now be more particularly described with reference to the accompanying figures and pointed out in the claims. It will be understood that the particular systems and methods described herein are shown by way of illustration only and not as limitations. As will be understood by those skilled in the art, the principles and features described herein may be employed in various and numerous embodiments without departing from the scope of any of the present inventions. As can be appreciated from the foregoing and the following description, each and every feature described herein, and each and every combination of two or more such features, is included within the scope of the present disclosure provided that the features included in such a combination are not mutually inconsistent. In addition, any feature or combination of features may be specifically excluded from any embodiment of any of the present inventions.

The foregoing Summary, including the description of some embodiments, motivations therefor, and/or advantages thereof, is intended to assist the reader in understanding the present disclosure, and does not in any way limit the scope of any of the claims.

BRIEF DESCRIPTION OF THE DRAWINGS

The accompanying figures, which are included as part of the present specification, illustrate the presently preferred embodiments and together with the general description given above and the detailed description of the preferred embodiments given below serve to explain and teach the principles described herein.

Figure 1:
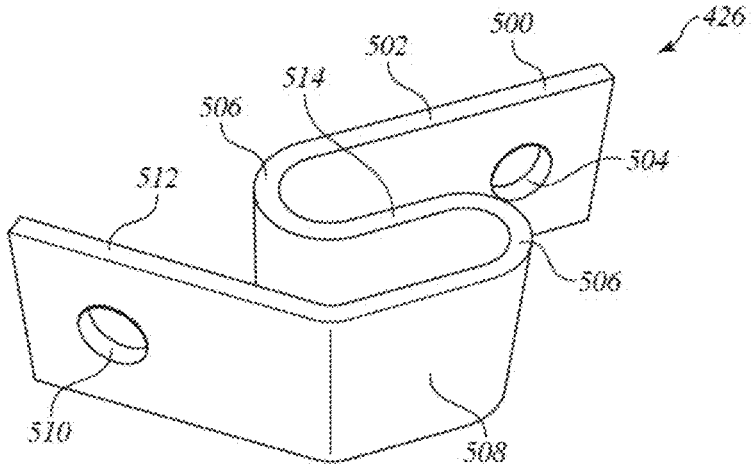
FIG. 1 is an isometric view of a container flange that may replace the container flange shown in FIGS. 1 and 2 of my patent application Ser. No. 17/990,199.

Like reference numerals refer to like parts throughout the several views of the drawings. While the present disclosure is subject to various modifications and alternative forms, specific embodiments thereof have been shown by way of example in the drawings and will herein be described in detail. The present disclosure should not be understood to be limited to the particular forms disclosed, but on the contrary, the intention is to cover all modifications, equivalents, and alternatives falling within the spirit and scope of the present disclosure.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the system as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

FIG. 14 of my patent application Ser. No. 17/990,199, which is incorporated by reference, depicts sidewalls 424 of soiled laundry containers to which are secured container flanges 426 that retain a mesh laundry bag. The mesh laundry bag may be stretched to be secured to the container flanges 426 and thus the mesh laundry is flexible and may be made of an elastic material.

As shown in FIG. 14 of my patent application Ser. No. 17/990,199, the left and right container sidewalls 424 of the soiled laundry container each include a pair of flanges 426 extending in opposite longitudinal directions of the respective container sidewall 424. The container flanges 426 are embedded in the respective container sidewalls 424 and do not extend outward from an edge of the respective container sidewalls 424. Each container flange 426 extends inward in a direction of a closest edge of a longitudinal side of a container sidewall 424. The container flanges 426 may replicate a functionality of the container flanges 126 to engage with edges of the mesh laundry bag. A top edge or top portion of the mesh laundry bag may engage with the container flanges 426 and the edges of the left and ride container sidewalls 424, without engaging with the edges of front and back container sidewalls.

Container flanges 126 as described herein may be included in container sidewalls of soiled laundry containers (e.g., soiled laundry containers 320). A container flange included in a container sidewall of a laundry container may extend along a longitudinal axis of the respective container sidewall, such that the container flange is inside and/or otherwise contained within the container sidewall. A container flange may be included in a container sidewall in place of and/or in addition to a container flange extending outwardly from the container sidewall.

The container flanges 426 may be embedded in (e.g., cut out of) a container sidewall 424 and may not extend outward from the container sidewall 424. The pair of container flanges 426 may extend along opposite longitudinal directions of the sidewall 424. In some embodiments, the container flange 426 may extend along opposite longitudinal directions in each of left and right container sidewalls 424. Alternatively or additionally, the pair of container flanges 426 may extend along opposite longitudinal directions in each of front and rear container sidewalls 424.

The container flanges 426 may have a width equivalent to and/or less than a width of a container sidewall 424. In some cases, a width of the container flanges 426 may be required to be at least three times a width and/or a diameter of voids (e.g., holes) included in a mesh material of a laundry bag. The width of the container flanges 426 being sufficiently (e.g., at least three times) greater than a width and/or a diameter of voids included in a mesh material of a laundry bag may reduce wear and/or abrasion on the laundry bag.

A top edge of the laundry bag is elastically stretchable, such that when the top edge or top portion of the laundry bag is stretched over at least some of the edges of the soiled laundry container, the top edge of the laundry bag compresses against the soiled laundry container and remains in place as shown in FIG. 14 of my U.S. patent application Ser. No. 17/990,199, which is incorporated herein by reference.

The soiled laundry container may include container flanges 426, such that when the top edge or top portion of the laundry bag is stretched over the container flanges 426 of the soiled laundry container, the top edge of the laundry bag 332 compresses against the soiled laundry container and remains in place. In some cases, the top portion of the laundry bag is stretchable over the container flanges 426 of the solid laundry container and beyond (below) the container flanges 426, such that it may elastically compress against the container flanges 426 on both a side and a bottom of the container flanges 426 while in use.

In this way, the container flanges 426 may prevent the folded-over top portion of the laundry bag from sliding upward towards the top opening of the soiled laundry container and thereby prevent the laundry bag from collapsing into the soiled laundry container. In some cases, the container flanges 426 of the solid laundry container may be of sufficient tensile strength as to substitute for the material (e.g., wood) used in the piece of furniture such as that shown in FIG. 14 of my patent application Ser. No. 17/990,199. In some cases, the container flanges 426 extend a lifespan of a laundry bag by preventing unnecessary wear.

All of the soiled and clean laundry containers, respectively, may include the aforementioned container bottom, container sidewalls 424, and container flange 426, and are interchangeably usable as soiled laundry containers or clean laundry containers.

Figure 2:
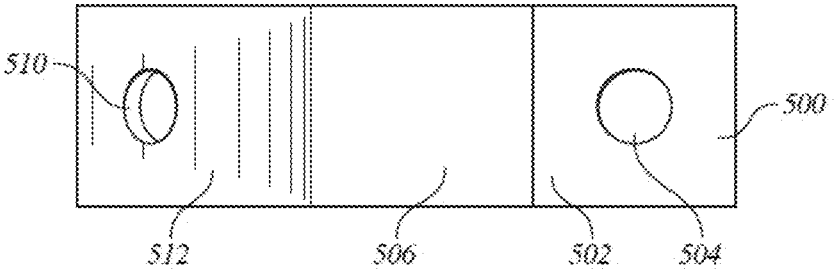
FIG. 2 is a top view of the container flange of FIG. 1.
Figure 3:
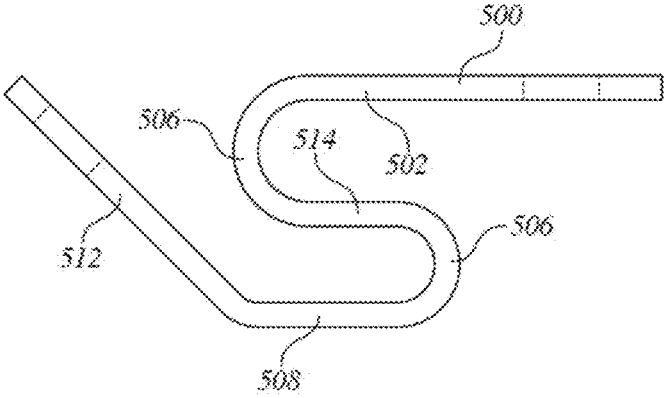
FIG. 3 is a side view of the container flange of FIG. 1.

FIGS. 1-3 show the container flange 426 that has a modified S-shape. The lowest profile way to line solid wooden drawers may well be with the container flange 426 of FIGS. 1-3 with the modified S-shape. For that reason, the modified S-shape container flange 426 could replace the container flanges of FIGS. 13A and 13B of my patent application Ser. No. 17/990,199. The added functionality to the screw hole 510 is considerably more accessible to the assembler (because of the 45 degree angle of the end segment 512 of FIG. 1 (any angle between 30 and 60 degrees would suffice) vs the previously difficult-to-reach 90 degree angle of the corresponding end segments of the container flanges of FIGS. 13A and 13B of my patent application Ser. No. 17/990,199), and reduces anterior and posterior flange designs to a single, universal design that may use to replace the J-shaped flange of FIG. 13A of FIG. 14 of my patent application Ser. No. 17/990,199 by modifying the recess to accommodate and tor replacing the S-shaped flange of FIG. 13B of FIG. 14 of my patent application Ser. No. 17/990,199 by modifying the recess to accommodate.

The S-shape flange of FIGS. 1-3 includes three parallel segments 502, 508 and 514 and two curved arc segments 506 that respectively extend from opposite sides of the segment 514 in opposite directions. One of the curved bent segments 506 joins with the segment 502 and the other with segment 508. In effect, a central region is formed having the S-shape constituted by the three parallel segments 502, 508 and 514 and the two curved arc segments 506. Segments 502, 508 and 514 are essentially straight and flat.

The flange 426 with the S-shape in FIGS. 1-3 also has end segments 500 and 512. End segment 500 extends from segment 502 to terminate and forms a straight angle with segment 502. End segment 512 extends from segment 508 and forms an acute angle with segment 508, preferably between 30 and 60 degrees such as 45 degrees. End segment 500 has an aperture 504 that extends through the end segment 500 to accommodate insertion of a fastener, such as a hole plug or hole plug button or alternatively a threaded screw, into the top of the sidewall of a drawer. End segment 512 has an aperture 510 extends through the end segment 512 to accommodate insertion of the fastener to be secured into a complementary inclined surface of a recess formed in the sidewall 424 of furniture (see FIG. 4) or in the front wall of the furniture. In that manner, one end segment 512 i.e., an inclined end segment) is secured to a recessed portion of the furniture and the other end segment 500 (i.e., a straight end segment) is secured to the furniture at locations neighboring but outside the recess. The aperture 504 instead may be shaped to have the contour of the fastener and thus avoid the need for a separate fastener.

The two end segments 500, 512 in effect extend in opposite directions from the central region that forms the S-shape, but with one segment 500 doing so by defining a straight angle from the parallel segment 502 and with another segment 512 doing so by defining an acute angle from the parallel segment 508.

Figure 4:
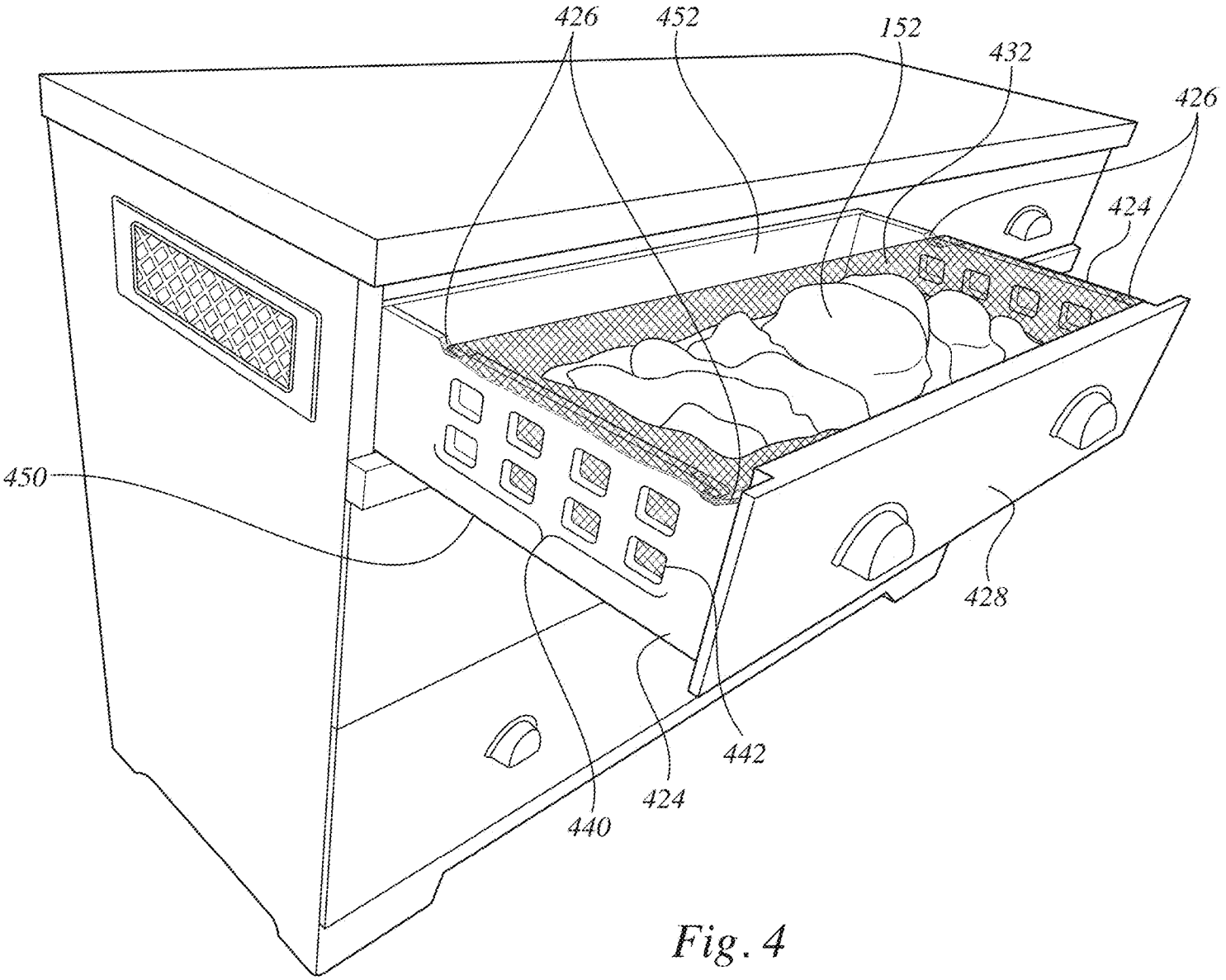
FIG. 4 is an isometric view of furniture equipped with a top drawer having four container flanges of FIGS. 1-3 that retain a stretched, mesh, laundry bag in an open position.

FIG. 4 shows a chest of drawers 450 (furniture) that corresponds to FIG. 14 of my patent application Ser. No. 17/990,199, except that the stretched mesh laundry bag 432 is to be retained by four S-shaped container flanges 426 instead of by just two S-shaped container flanges 426 and two J-shaped container flanges. While only one ventilation structure 452 is depicted, there is another in alignment in the opposite wall of the chest of drawers 450.

Each drawer sidewall 436 has a set 440 of ventilation openings 442 (such as eight) that will align with ventilation structures 452 on each side of the chest of drawers 450. While only one set is shown in one of the sidewalls 436, the other sidewall 436 has its own set as well that is symmetric to the set shown.

Figure 5:
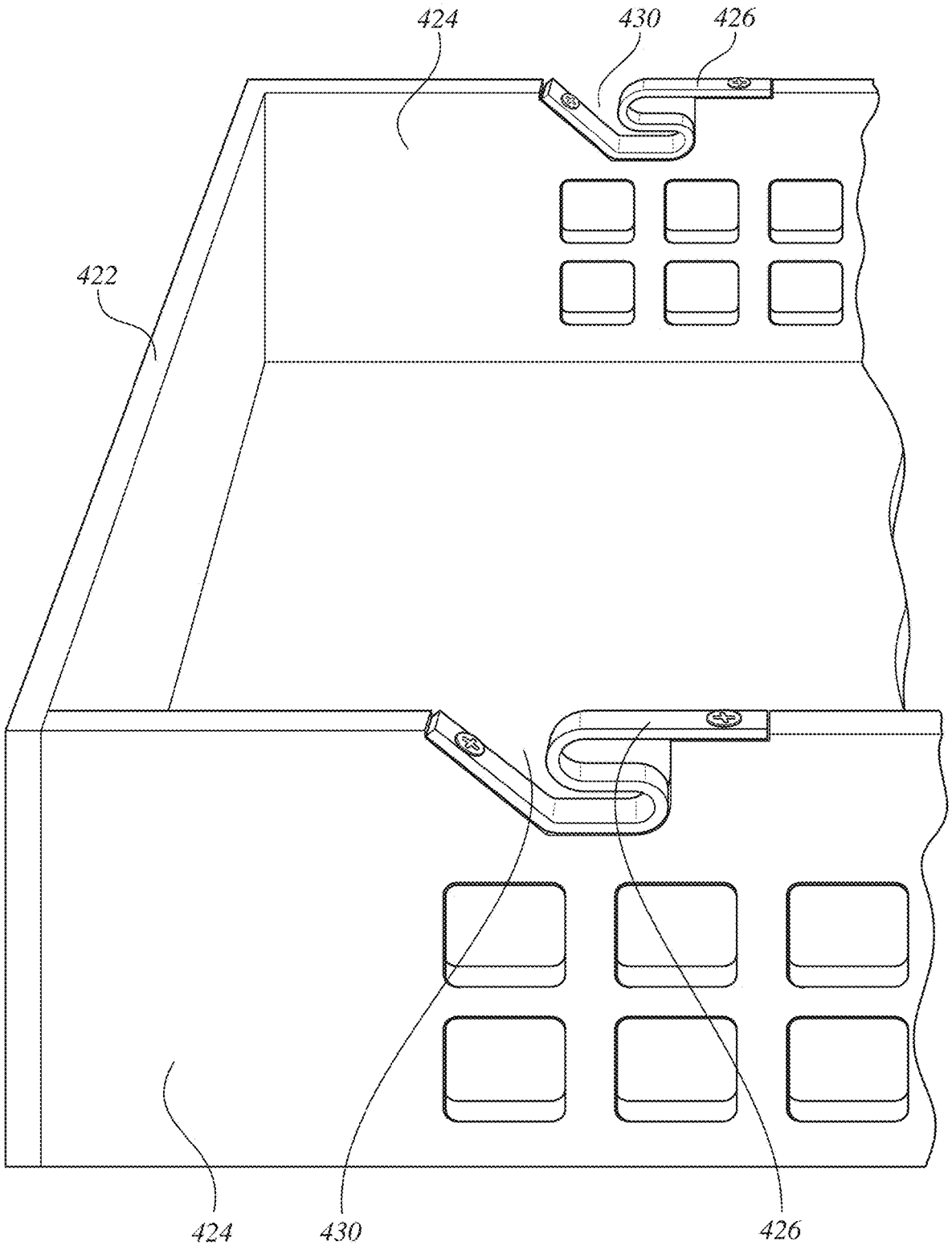
FIG. 5 is an isometric view of the container flange of FIGS. 1-3 at a rearward location secured to a recess of a sidewall of the top drawer of the furniture of FIG. 4.

FIG. 5 shows a "rearward" pair of the S-shaped container flanges 426 that are in alignment with each other across the drawer of furniture and closer to the rear wall 422 than to the front wall 428. The screws used to secure the S-shaped container flanges 426 to the sidewall 436 are conventional. Only their heads are depicted, but the screws also have threaded stems each resembling that shown in FIG. 6 in connection with the "forward" S-shaped container flange.

Figure 6:
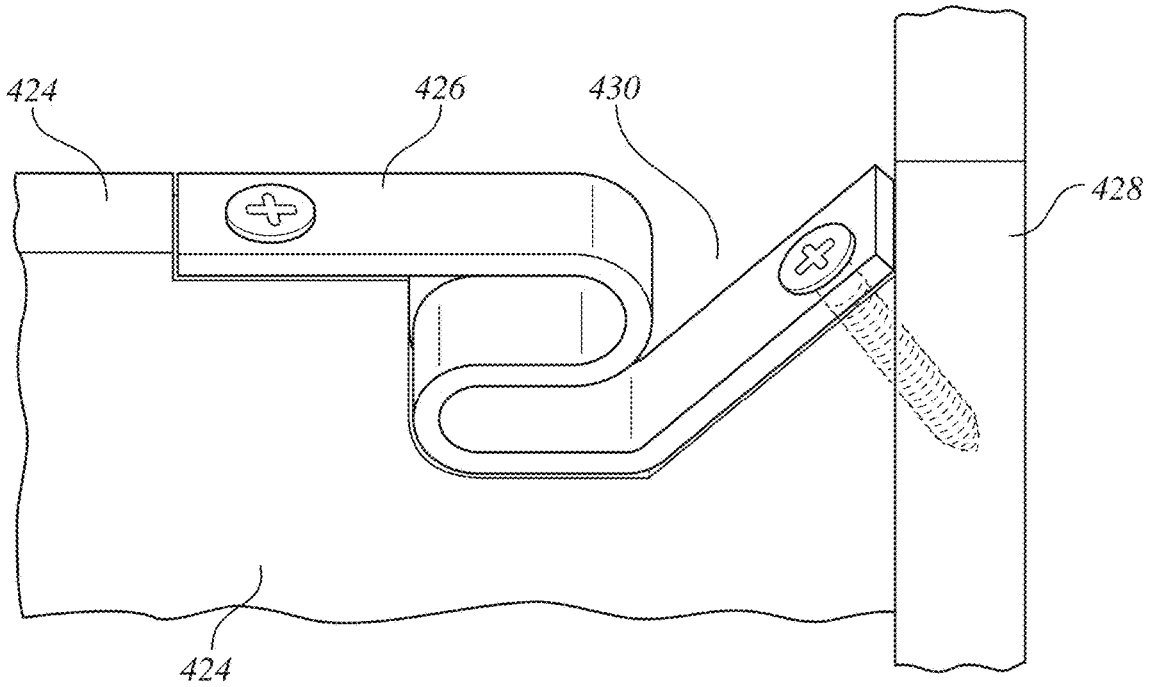
FIG. 6 is an isometric view of the container flange of FIGS. 1-3 at a forward location secured to a recess of a front wall of the top drawer of the furniture of FIG. 4.
Figure 7:
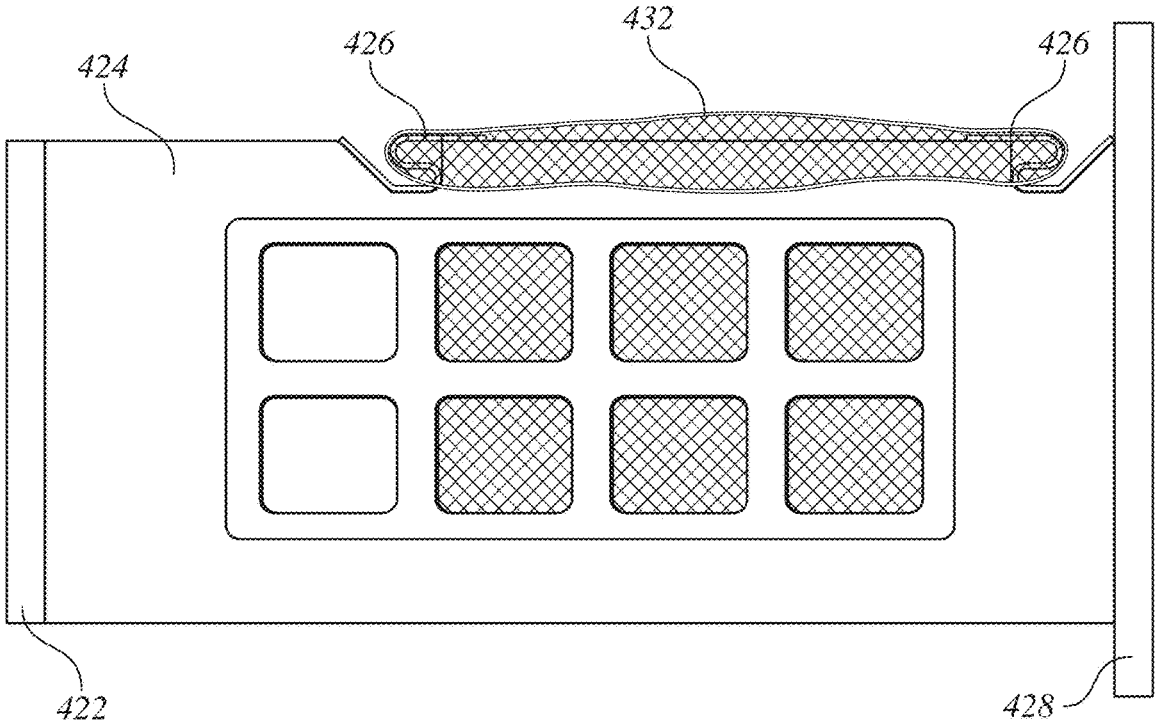
FIG. 7 is an isometric view of a manner of attachment of the laundry bag to the container flange of FIGS. 1-3.

FIG. 6 shows one of a pair of "forward" S-shaped container flanges 426 that are in alignment with each other across the drawer of furniture and are closer to the front wall 428 than to the rear wall 422. There are two apertures 504 (FIGS. 1-3) each accommodating a fastener, such as a threaded screw. A threaded screw is shown in FIG. 6 extending through the sidewall 426 and into the front wall 438 and like screws are used elsewhere to secure the S-shaped container flanges 426 to the sidewalls 426.

The four S-shaped container flanges 426 are in respective recesses 430 in respective sidewalls 424 of the drawer of furniture. Soiled laundry 152 is placed into the mesh laundry bag 432, which may be sorted by type of laundry (socks or shirts, for instance) or just belonging to a common user or owner. FIG. 5 shows the manner in which an inclined end segment 512 (FIGS. 1-3) of the S-shaped container flange 426 is secured to a complementary inclined surface of a recess 430 in the sidewall 426 of a drawer and in which the straight end segment 500 (FIGS. 1-3) of the S-shaped container flange 426 is secured to a top edge of the sidewall 428 of the drawer. FIG. 6 does the same except that one of its fasteners is secured to the front wall 428. The S-shaped container flanges 426, preferably made of metal, need to be universally tumbled or de-burred in order to ensure proper suspension of the mesh liner, which may be a stretchable, resilient elastic band at the mouth of the laundry bag. In use, the mesh liner is stretched to compress against the central segments of the container flanges 426 and extends into free space behind the rear container flanges 426. The free space is between the rear wall 422 and the two rear container flanges 426. The mesh liner may be secured to the mouth region of the laundry bag in any conventional manner and could be a draw string extending though loops at the mouth.

The drawer may slide back and forth along tracks attached to the inner facing side of the sidewalls 436 of the drawer in a conventional manner between a pushed-in position and a pulled-out position so that its contents (i.e., laundry in the laundry bag 432) are accessible for removal with the drawer in the pulled-out position of the drawer and inaccessible in the pushed-in position of the drawer.

Terminology

The phrasing and terminology used herein is for the purpose of description and should not be regarded as limiting.

Measurements, sizes, amounts, and the like may be presented herein in a range format. The description in range format is provided merely for convenience and brevity and should not be construed as an inflexible limitation on the scope of the invention. Accordingly, the description of a range should be considered to have specifically disclosed all the possible subranges as well as individual numerical values within that range. For example, description of a range such as 1-20 meters should be considered to have specifically disclosed subranges such as 1 meter, 2 meters, 1-2 meters, less than 2 meters, 10-11 meters, 10-12 meters, 10-13 meters, 10-14 meters, 11-12 meters, 11-13 meters, etc.

Furthermore, connections between components or systems within the figures are not intended to be limited to direct connections. Rather, data or signals between these components may be modified, re-formatted, or otherwise changed by intermediary components. Also, additional or fewer connections may be used. The terms "coupled," "connected," or "communicatively coupled" shall be understood to include direct connections, indirect connections through one or more intermediary devices, wireless connections, and so forth.

Reference in the specification to "one embodiment," "preferred embodiment," "an embodiment," "some embodiments," or "embodiments" means that a particular feature, structure, characteristic, or function described in connection with the embodiment is included in at least one embodiment of the invention and may be in more than one embodiment. Also, the appearance of the above-noted phrases in various places in the specification is not necessarily referring to the same embodiment or embodiments.

The use of certain terms in various places in the specification is for illustration purposes only and should not be construed as limiting. A service, function, or resource is not limited to a single service, function, or resource; usage of these terms may refer to a grouping of related services, functions, or resources, which may be distributed or aggregated.

Furthermore, one skilled in the art shall recognize that: (1) certain steps may optionally be performed; (2) steps may not be limited to the specific order set forth herein; (3) certain steps may be performed in different orders; and (4) certain steps may be performed simultaneously or concurrently.

The term "approximately", the phrase "approximately equal to", and other similar phrases, as used in the specification and the claims (e.g., "X has a value of approximately Y" or "X is approximately equal to Y"), should be understood to mean that one value (X) is within a predetermined range of another value (Y). The predetermined range may be plus or minus 20%, 10%, 5%, 3%, 1%, 0.1%, or less than 0.1%, unless otherwise indicated.

The indefinite articles "a" and "an," as used in the specification and in the claims, unless clearly indicated to the contrary, should be understood to mean "at least one." The phrase "and/or," as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements).

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of items, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning.

As used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements).

The use of "including," "comprising," "having," "containing," "involving," and variations thereof, is meant to encompass the items listed thereafter and additional items.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous. Other steps or stages may be provided, or steps or stages may be eliminated, from the described processes. Accordingly, other implementations are within the scope of the following claims.

It will be appreciated by those skilled in the art that the preceding examples and embodiments are exemplary and not limiting to the scope of the present disclosure. It is intended that all permutations, enhancements, equivalents, combinations, and improvements thereto that are apparent to those skilled in the art upon a reading of the specification and a study of the drawings are included within the true spirit and scope of the present disclosure. It shall also be noted that elements of any claims may be arranged differently including having multiple dependencies, configurations, and combinations.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention.

Accordingly, the foregoing description and drawings are by way of example only.

While the foregoing description and drawings represent the preferred embodiments of the present invention, various changes and modifications may be made without departing from the scope of the present invention.

What is claimed is:

1. A device suited to retain a laundry bag open in a drawer, comprising:

at least one flange having a straight end segment, an inclined end segment and a central segment between, the central segment having three straight portions and two arc portions, one of the straight portions and one of the arc portions being contiguous with each other, another of the straight portions and another of the arc portions being contiguous with each other, the three straight portions each being parallel to each other and arranged spaced one over another, the straight end segment being contiguous with and extending outward from one of the straight portions to define a straight angle between, the inclined end segment being contiguous with and extending outward in an inclined manner from a further of the straight portions to define an acute angle between, a middle one of the three straight portions being contiguous with and between the two curved arc portions so that the two curved arc portions separate the middle one of the three straight portions from respective ones of a remaining two of the straight portions.

2. The device of claim 1, wherein the acute angle is between 30 and 60 degrees.

3. The device of claim 2, wherein the acute angle is 45 degrees.

4. The device of claim 1, wherein each of the straight and inclined end segments have a respective formation, the straight and inclined end segment each having a contour defined by a respective surface that terminates at the respective formation, the respective formation being selected from a group consisting of an aperture and a contour of a fastener.

5. A device suited to retain a laundry bag open in a drawer in combination with a furniture drawer having a sidewall, comprising:

at least one flange having a straight end segment, an inclined end segment and a central segment between, the central segment having at least two straight potions and two arc portions, one of the straight portions and one of the arc portions being contiguous with each other, another of the straight portions and another of the arc portions being contiguous with each other, the two straight portions being parallel to each other, the straight end segment being contiguous with and extending outward from one of the straight portions to define a straight angle between, wherein the inclined end segment is contiguous with and extends outward in an inclined manner from a further of the straight portions to define an acute angle between, the sidewall having a recess with an inclined surface to which is secured the inclined end segment, the sidewall having an edge to which is secured the straight end segment at a location away from the recess.

6. The device of claim 5, wherein a pair of the flanges is secured to the front wall and to respective ones of the sidewalls, a remaining pair of the flanges being secured to the respective ones of the sidewalls.

7. The device of claim 6, wherein the furniture drawer is part of a piece of furniture, wherein the piece of furniture has a side with a ventilation structure having openings.

8. The device of claim 5, wherein the pair of sidewalls each have a respective set of openings, each of the respective sets being in alignment with each other.

9. A device suited to retain a laundry bag open in a drawer in combination with a laundry bag and a furniture drawer having a rear wall, a front wall, and a pair of sidewalls extending between the rear wall and the front wall, comprising:

at least one flange having a straight end segment, an inclined end segment and a central segment between, the central segment having at least two straight potions and two arc portions, one of the straight portions and one of the arc portions being contiguous with each other, another of the straight portions and another of the arc portions being contiguous with each other, the two straight portions being parallel to each other, the straight end segment being contiguous with and extending outward from one of the straight portions to define a straight angle between, the inclined end segment being contiguous with and extending outward in an inclined manner from a further of the straight portions to define an acute angle between, wherein the pair of sidewalls each have one recess in alignment with each other across the furniture drawer and having a further recess in alignment with each other across the furniture drawer, the at least one flange including four flanges each having associated ones of the inclined end segments in the respective ones of the one recess and the further recess of the sidewalls and having associated ones of the straight end segments secured to the furniture drawer with each other, the two straight portions being parallel to each other, the straight end segment being contiguous with and extending outward from one of the straight portions to define a straight angle between, the inclined end segment being contiguous with and extending outward in an inclined manner from a further of the straight portions to define an acute angle between.

10. A method of retaining a laundry bag open in a drawer, comprising:

securing an inclined end segment of at least one flange to an inclined surface in a recess of a sidewall of a furniture drawer;

securing a straight end segment of the at least one flange to an edge of the sidewall at a location away from the recess, wherein the at least one flange also has a central segment between the inclined end segment and the straight end segment, the central segment having at least two straight potions and two arc portions, one of the straight portions and one of the arc portions being contiguous with each other, another of the straight portions and another of the arc portions being contiguous contour defined by a respective surface that terminates at the respective formation, and selecting the respective formation from a group consisting of an aperture and a contour of a fastener.

11. The method of claim 10, wherein the central segment has three of the straight portions that are parallel with each other and arranged one spaced over another, a middle one of the three straight portions being contiguous with and between the two curved arc portions so that the two curved arc portions separate the middle one of the three straight portions from respective ones of a remaining two of the straight portions.

12. The method of claim 10, wherein the acute angle is between 30 and 60 degrees.

13. The method of claim 10, wherein the acute angle is 45 degrees.

14. The method of claim 10, in combination with a laundry bag and a furniture drawer having a rear wall, a front wall, and a pair of sidewalls extending between the rear wall and the front wall, the pair of sidewalls each having one recess in alignment with each other across the furniture drawer and having a further recess in alignment with each other across the furniture drawer, the at least one flange including four flanges each having associated ones of the inclined end segments in the respective ones of the one recess and the further recess of the sidewalls and having associated ones of the straight end segments secured to the furniture drawer at locations away from the one recess and the further recess of the sidewalls, and pressing a portion of the laundry bag against the four flanges that, until manually released, maintains the the laundry bag open to receive a load of laundry.

15. The method of claim 14, wherein the pair of sidewalls each have a respective set of openings, each of the respective sets being in alignment with each other.

16. The method of claim 15, wherein the furniture drawer is part of a piece of furniture, wherein the piece of furniture has a side with a ventilation structure having openings.

17. The method of claim 10, wherein each of the straight and inclined end segments have a respective formation, the straight and inclined end segment each having a at locations away from the one recess and the further recess of the sidewalls, the laundry bag having a portion pressed against the four flanges that, until manually released, maintains the laundry bag open to receive a load of laundry.

18. The method of claim 10, further comprising:

securing a pair of the flanges to the front wall and to respective ones of the sidewalls, and securing a remaining pair of the flanges to the respective ones of the sidewalls.

* * * * *